US006152446A

United States Patent [19]

Takano et al.

[11] Patent Number: 6,152,446

[45] Date of Patent: Nov. 28, 2000

[54] PACHINKO GAME MACHINE MOUNTING UNIT AND METHOD OF PRODUCING PACHINKO ISLAND

[75] Inventors: Kazuhiko Takano; Akio Yokota; Kazuo Fukai, all of Saitama-ken; Shohachi Ugawa, Gumma-ken; Takeo Aoki, Saitama-ken, all of Japan

[73] Assignee: Sanyo Electric Co., Ltd., Osaka-Fu, Japan

[21] Appl. No.: 08/905,657

[22] Filed: Aug. 4, 1997

Related U.S. Application Data

[63] Continuation-in-part of application No. 08/606,536, Feb. 23, 1996, abandoned.

[30] Foreign Application Priority Data

Feb. 24, 1995 [JP] Japan ..... 7-061751
Aug. 30, 1996 [JP] Japan ..... 8-231120

[51] Int. Cl.[7] ..... A63F 7/02
[52] U.S. Cl. ..... 273/121 B
[58] Field of Search ..... 273/118, 121, 273/119

[56] References Cited

U.S. PATENT DOCUMENTS 5,292,131 3/1994 Takemoto et al. ..... 273/121 B X
5,492,326 2/1996 Takemoto et al. ..... 273/121 B X

FOREIGN PATENT DOCUMENTS 4-312487 11/1992 Japan ..... 273/121 B
4-312488 11/1992 Japan ..... 273/121 B
4-317683 11/1992 Japan ..... 273/121 B
5-23432 2/1993 Japan ..... 273/121 B
5-68749 3/1993 Japan ..... 273/121 B
5-161755 6/1993 Japan ..... 273/121 B
5-208073 8/1993 Japan ..... 273/121 B
6-39136 2/1994 Japan ..... 273/121 B
6-54959 3/1994 Japan ..... 273/121 B
6-165859 6/1994 Japan ..... 273/121 B
6-198064 7/1994 Japan ..... 273/121 B
6-246061 9/1994 Japan ..... 273/121 B
6-277352 10/1994 Japan ..... 273/121 B
WO 93/06902 4/1993 WIPO ..... 273/121 B
WO 94/19077 9/1994 WIPO ..... 273/121 B

*Primary Examiner*—Raleigh W. Chiu
*Attorney, Agent, or Firm*—Darby & Darby

[57] ABSTRACT

A pachinko game machine mounting unit capable of promoting its mass production, shorten its construction period and reduce a construction cost of a pachinko island. The unit is equipped with a playing ball supply tank for supplying playing balls to pachinko game machines and further to playing ball hire-out apparatus, a playing ball collecting tank for collecting the playing balls, a raising apparatus for transferring the playing balls from the playing ball collecting tank up to the playing ball supply tank, a prize ball accepting opening provided in a counter table in correspondence with each of the pachinko game machines, a cover member for opening and closing each of the prize ball accepting openings, a prize ball collecting conduit for making a communication between the prize ball accepting openings and the playing ball collecting tank, a prize ball counter for counting prize balls flowing downwardly along the prize ball collecting conduit, and a receipt issuing device for printing the number of the prize balls counted by the prize ball counter to issue a receipt.

10 Claims, 3 Drawing Sheets

PACHINKO GAME MACHINE MOUNTING UNIT AND METHOD OF PRODUCING PACHINKO ISLAND

This application is a continuation-in-part application of Ser. No. 08/606,536, filed Feb. 23, 1996 abandoned.

BACKGROUND OF THE INVENTION

1. Field of the Invention

The present invention relates to a pachinko game machine mounting unit and arrangement thereof which are useful for successively arranging a number of pachinko game machines in rows to produce a pachinko game machine block, a so-called pachinko island.

2. Background Art

A pachinko game is one of the most favorable games in Japan, in which playing balls are flipped into a game board of the pachinko game machine at a predetermined rate by the handle operation of the player and guided by nails arranged on the game board, and during the dropping of the playing balls, one of the playing balls enters into the winning entrance. If a playing ball wins, a predetermined number of playing balls are discharged onto an output tray provided at a lower portion of the game board as prize balls which can be used as playing balls which are flipped again onto the game board or collected as final prize balls which can be exchanged for one or a plurality of premiums based upon the total number of prize balls.

Recently the number of recreation halls for pachinko game is increasing for satisfying the players' need. Generally, in such a recreation hall or the like the pachinko island, which is a block having a plurality of pachinko game machines is assembled while materials are processed on the spot. Accordingly, the workers need to have special knowledge and skills, and its construction period is long, besides various troubles frequently arises. In order to eliminate these problems, as exemplified by the Japanese Examined Published Patent Application No. 5-25517 there has been known a technique in which one pachinko island is divided into same pieces each of which in turn, is constructed as one unit to improve the assembling efficiency on the spot. However, in this case, various kinds of units are required to make up one pachinko island, whereas the kinds of units necessary are not decidable until the layout within the recreation hall is settled, with the result that difficulty is experienced in the mass production of the units concerned. In addition, the raising apparatus is different from others at every recreation hall, and hence the raising apparatus incorporated unit needs to change or alter on every spot, which also makes it difficult to mass-produce them.

Moreover, although the players are necessary to carry heavy ball boxes accommodating prize balls (pachinko balls) for the exchange with a premium or a gift, in order to reduce the troubles imposed on the players, the Japanese Examined Published Application No. 5-68999 has disclosed a technique in which an opening or inlet is provided in a counter table and prize balls are thrown into the opening to be counted to issue a receipt corresponding to the number of the prize balls counted. However, in this case, the mounting works for a prize ball counting apparatus and a receipt issuing apparatus are necessary at every pachinko island, which causes the construction period to lengthen.

SUMMARY OF THE INVENTION

The present invention has been developed with a view to eliminating such problems, and it is therefore an object of the present invention to a pachinko game machine mounting unit which allows the mass production and which permits the reduction of the construction period, thus reducing the construction cost.

For this purpose, in accordance with an aspect of the present invention, a pachinko game machine mounting unit made for arranging and setting a plurality of pachinko game machines in a row on a frame body, comprises a playing ball supply tank disposed at an upper portion of the frame body for supplying playing balls to at least the pachinko game machines on the frame body, a playing ball collecting tank disposed at a lower portion of the frame body for collecting the playing balls, a raising apparatus disposed on the frame body for carrying the playing balls from the playing ball collecting tank to the playing ball supply tank connected with the playing ball collecting tank, a prize ball accepting opening formed for each of the pachinko game machines, a prize ball counter disposed in the frame body for counting the prize balls thrown into the prize ball accepting opening, and a recording device disposed on the frame body for recording the number of the prize balls counted in the prize ball counter.

According to this pachinko game machine mounting unit, the prize balls thrown into the prize ball accepting opening and the balls discharged from the pachinko game machine are stored in the playing ball collecting tank and further stored in the playing ball supply tank by means of the raising means. Since the playing ball within the playing ball supply tank are supplied into the pachinko game machine, the playing balls can be circulated within the pachinko game machine mounting unit, which does not require a large-scale playing ball supplying apparatus. In addition, even in a case where owing to a great success or the like a large number of prize balls are discharged from the pachinko game machine, since the prize ball accepting opening is provided in front of the player, the player can count prize balls becomes on all such occasions to receive a medium in which the number of the prize balls is recorded. Accordingly, the balls discharged from the unit are returned to the same unit so that the playing balls circulate smoothly within the unit, besides the player is not required to carry the heavy ball boxes accommodating the prize balls with him, thus resulting in avoiding the situation in which the ball boxes are piled up in the narrow passages of the recreation hall.

In this case, the prize ball counter is one in number and covers the plurality of prize ball accepting openings, and preferably the pachinko game machine mounting unit further comprises a cover member for opening and closing each of the plurality of prize ball accepting openings, a locking mechanism connectable and disconnectable with and from each of the cover members for locking and unlocking each of the cover members on each of the prize ball accepting openings, and interlocking means for, when one locking mechanism is in an unlocking condition, causing the other locking mechanisms to come into locking conditions.

According to this additional arrangement, in the case that one locking mechanism is in the unlocking condition, the other locking mechanisms come into the locking conditions, and hence no two or more prize ball accepting openings are simultaneously opened, with the result that it is possible to prevent his own prize balls from being counted together with the other person's prize balls. In addition, a single prize ball counter can deal with the plurality of prize ball accepting openings, which can simplify the arrangement of the unit.

Further, preferably the cover members constitute a portion of a counter table and are allowed to slide. Still further, preferably the prize ball counter is provided for each of the plurality of pachinko game machines, and the recording device is also provided for each of the plurality of pachinko game machines.

According to these arrangements, when the prize balls are thrown into the prize ball accepting opening, since the cover member is slidable to expose the prize ball accepting opening and further to allow the ball box to be placed on its surface, throwing the prize balls into the prize ball accepting opening becomes easy. Furthermore, since one prize ball counter is provided for each of the pachinko game machines, a plurality of players can simultaneously count the their prize balls. In addition, since one recording device is provided for one of the pachinko game machines, a plurality of players can simultaneously receive the media with the numbers of the prize balls.

Moreover, preferably the uppermost portion of the frame body is equipped with a hanger or the lowermost portion of the frame body is equipped with a moving roller, besides a side portion of the frame body is provided with coupling means for allowing a connection with a different pachinko game machine mounting unit.

According to these arrangements, in the case that the units are loaded into a truck or in the case that they are unloaded from the truck, the units can be lifted and lowered using the hangers and hence the work becomes easier. Furthermore, because of using the moving roller, the movements and positioning of the units carried into the recreation hall become easier. Moreover, the utilization of the coupling means can make the construction of the pachinko island simplified.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE PREFERRED EMBODIMENTS

Figure 1:
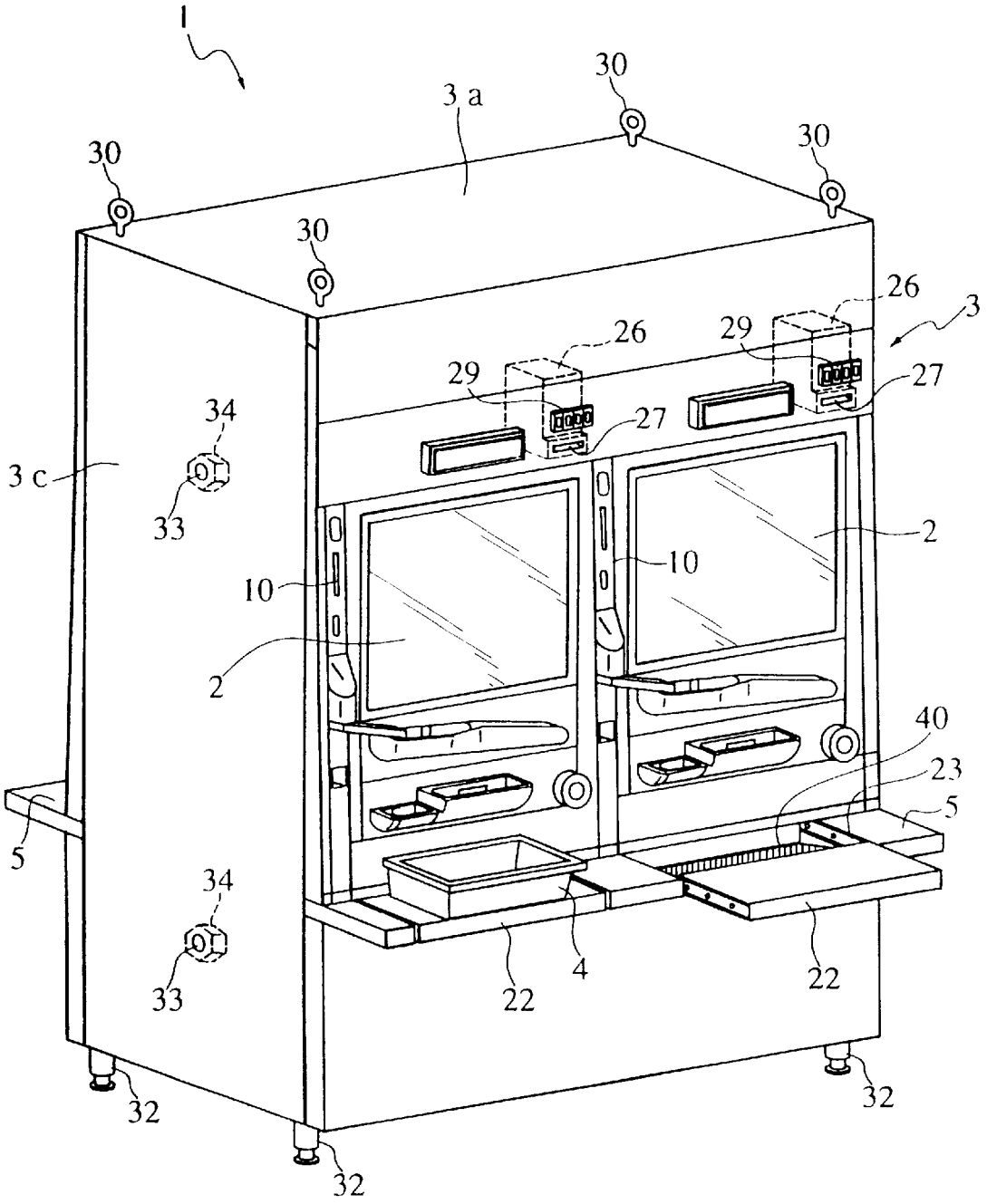
FIG. 1 is a perspective view showing a pachinko game machine mounting unit according to an embodiment of the present invention.

Referring now to the drawings, a detailed description will be made hereinbelow of a pachinko game machine mounting unit according to a preferred embodiment of the present invention. FIG. 1 is a perspective view showing a pachinko game machine mounting unit into which pachinko game machines are fitted. In the illustration, the pachinko game machine mounting unit, designated at numeral 1, comprises a frame body 3 which has a box-like configuration and which has both surfaces (front and rear surfaces) standing back to back, each of the surfaces accepting two pachinko game machines 2 disposed side by side. In addition, each of the front and rear surfaces of the frame body 3 is fixedly equipped with a counter table 5. Incidentally, the frame body 3 is reinforced with longitudinal beams and cross beams, not shown.

Figure 2:
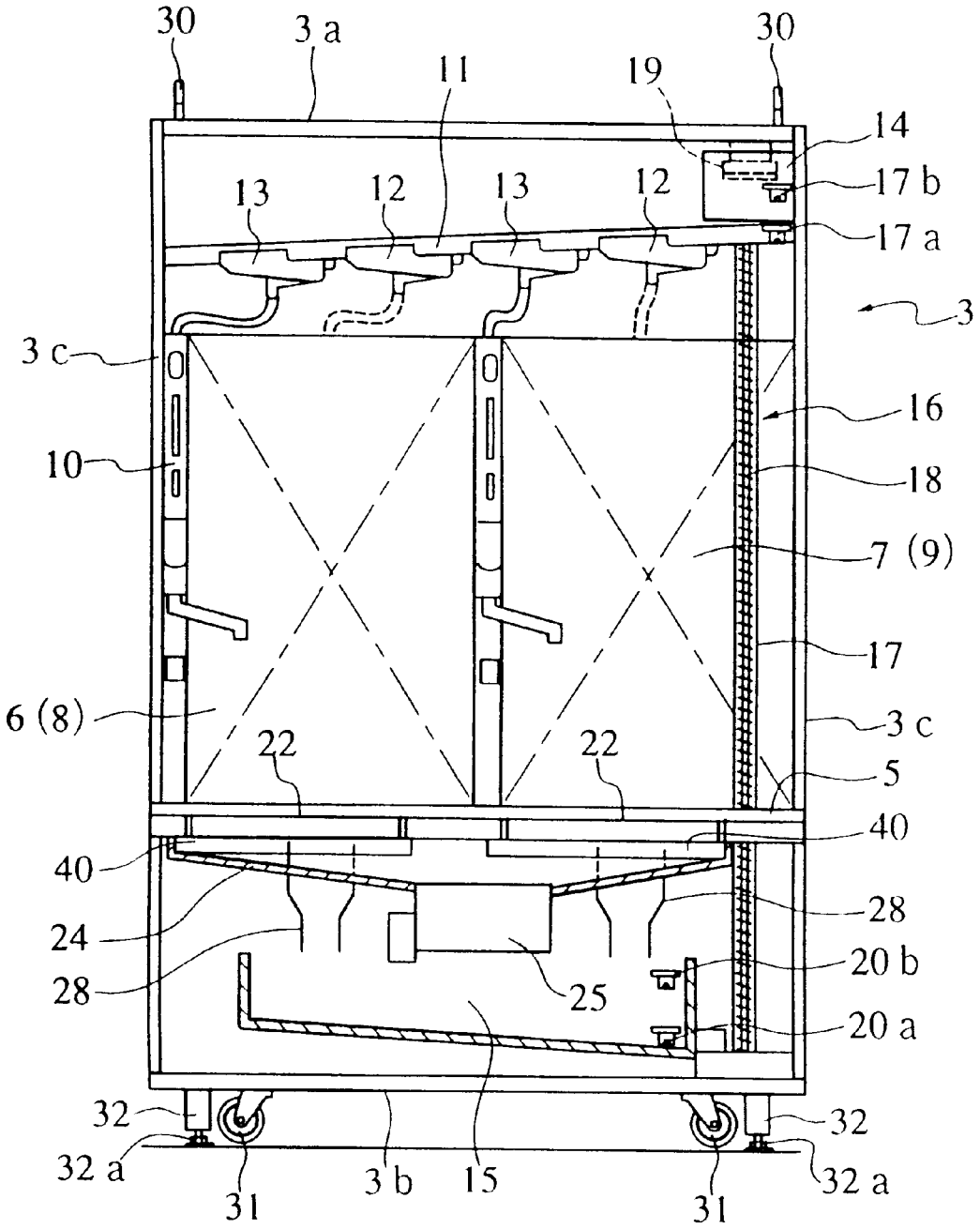
FIG. 2 is a front elevational view showing a state in which a front plate is removed from the unit shown in FIG. 1.
Figure 3:
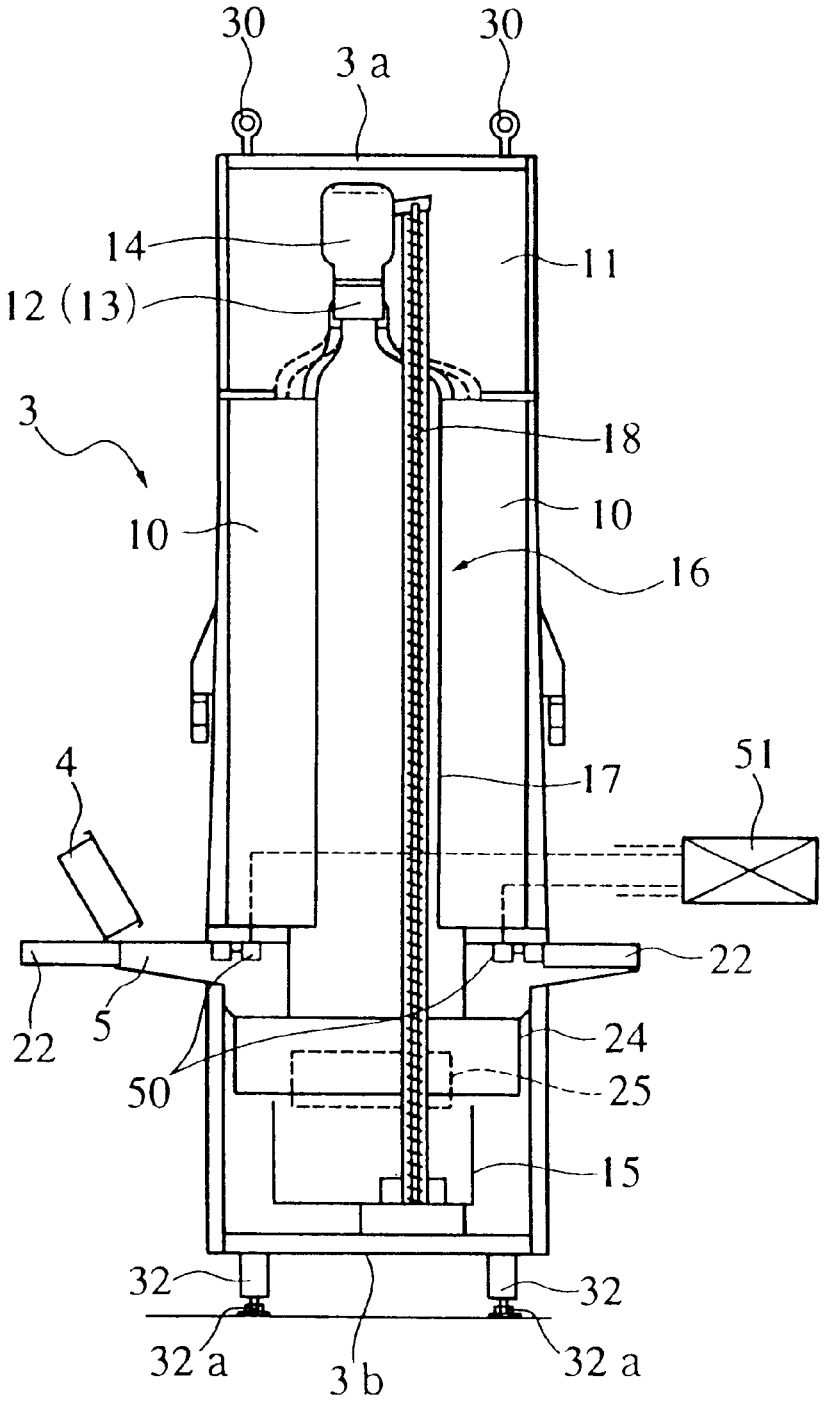
FIG. 3 is a side elevational view showing a state in which a side plate is removed from the unit shown in FIG. 1.

As shown in FIGS. 2 and 3, pachinko game machine fitting sections 6, 7 are formed in central portions of the front surface of the frame body 3 so that two pachinko game machines are fitted into the fitting sections 6, 7, respectively, to be disposed side by side. Similarly, pachinko game machine fitting sections 8, 9 are formed in central portions of the rear surface of the frame body 3 so that two pachinko game machines are fitted thereinto, respectively, to be disposed side by side. In addition, the pachinko game machine fitting sections 6, 8 are placed in opposed relation to each other, that is, stand back to back, while the pachinko game machine fitting section 7, 9 are also disposed in opposed relation to each other. Accordingly, when the pachinko game machines 2 are respectively fitted into the pachinko game machine fitting sections 6 to 9, the two pachinko machines 2 in the front or rear surface come into the side-by-side relation to each other, whereas the two pachinko game machines 2 in the front surface get into the back-to-back relation to the two pachinko machines in the rear surface, respectively.

Furthermore, to the frame body 3 there are fixed playing ball hire-out devices 10 each for hiring out a given number of playing balls for a player in response to the insertion of a coin or a magnetic card thereinto. Each of the playing ball hire-out devices 10 is located to be adjacent to each of the pachinko game machine fitting sections 6 to 9 for user's conveniences. However, in a case there the pachinko game machines 2 into which the playing ball hire-out devices 10 are integrally incorporated are fitted into the pachinko game machine mounting unit 1, needless to say, there is no need for the playing ball hire-out devices 10 to be provided in the frame body 3. Further, it is also possible that the playing balls are hired out from the pachinko game machine 2 on the basis of the information from a magnetic card inserted into the playing ball hire-out device 10.

On an upper portion of the aforesaid frame body 3, there is provided a supply conduit inclined and made to supply the playing balls to the pachinko game machines 2 and further to the playing ball hire-out devices 10. At the vicinity of the supply conduit 11, there are situated prize ball pans 12 for supplying the prize balls to the pachinko game machines 2 and further playing ball pans 13 for supplying the playing balls to the playing ball hire-out devices 10. In addition, to an upstream side end portion of the supply conduit 11 there is fixedly secured a playing ball supply tank 14 for the storage of the playing balls. This playing ball supplying tank 14 is communicated with the supply conduit 11 which in turn, is coupled to the prize ball pans 12 and further to the playing ball pans 13, with the result that the playing balls discharged from the playing ball supply tank 14 flow downwardly along the supply conduit 11 while moderately dropping into the prize ball pans 12 and the playing ball pans 13.

The capacity of the playing ball supply tank 14 depends upon the scale of the recreation hall. Further, the playing ball supply tank 14 accommodates lower- and upper-limit sensors 17*a*, 17*b* for sensing the quantity of the playing balls within the playing ball supply tank 14.

Moreover, at a lower portion of the frame body 3 there is provided a playing ball collecting tank 15 for storing the prize balls thrown into a prize ball accepting opening 40, which will be described later, and further for storing output balls discharged from the pachinko game machines 2. This playing ball collecting tank 15 has an inclined configuration, and is, at its downstream side end portion, equipped with lower- and upper-limit sensors 20*a*, 20*b* for sensing the quantity of the balls within the tank 15. Furthermore, in a side portion of the frame body 3, there is provided a raising apparatus 16 for making a communication between the playing ball supply tank 14 and the playing ball collecting tank 15 and for transferring the playing balls from the playing ball collecting tank 15 up to the playing ball supply tank 14. This raising apparatus 16 is composed of a cylindrical body 17 stretched between the playing ball supply tank 14 and the playing ball collecting tank 15, a rotary shaft 18 having a spiral configuration and extending in the cylindrical body 17, and a motor 19 for driving the rotary shaft 18. Thus, the motor 19 is driven in response to the actuation of the lower-limit sensor 17*a* of the playing ball supply tank 14 and the rotation of the rotary shaft 18 made due to the drive of the motor 19 raises the playing balls along the cylindrical body 17. Further, after the playing balls within the playing ball collecting tank 15 are transferred up to the playing ball supply tank 14, the upper-limit sensor 17*b* actuates to stop the motor 19. In this case, it is more preferable that the raising apparatus 16 incorporates a playing ball polishing function.

As described before, since the frame body 3 includes the playing ball supply tank 14, the playing ball collecting tank 15 and the raising apparatus 16, the playing balls can be stored within the playing ball collecting tank 15 as well as being stored within the playing ball supply tank 14 by means of the raising apparatus 16. Further, the playing balls within the playing ball supply tank 14 are fed to the pachinko game machines 2 and to the playing ball hire-out device 10, and hence the playing balls can be circulated within the pachinko game machine mounting unit 1, which does not require a large-scale playing ball supply apparatus.

Secondly, a description will be made hereinbelow of an arrangement whereby the prize balls are counted to issue a receipt or a recording medium such as a magnetic card. As shown in FIGS. 1 and 2, at the positions facing the respective pachinko game machine fitting sections 6 to 9, four prize ball accepting openings 40 are formed in counter tables 5. Each of the prize ball accepting openings 40 are located above the playing ball collecting tank 15 and is made to be freely openable and closable by means of a cover member 22 constituting a portion of the counter table 5. This cover member 22 can slide forwardly and backwardly along guide rails 23. Accordingly, when the player pulls backwardly the cover member 22 in front of him, the prize ball accepting opening 40 appears, besides the ball box 4 can be put on the upper surface of the cover member 22. On the other hand, when the player pushes the cover member 22 forwardly, the prize ball accepting opening 40 is closed so that the upper surface of the cover member 22 and the upper surface of the counter table 22 lay in the same plane. Incidentally, it is also possible that the cover member 22 is not provided on the prize ball accepting opening 40 or the cover member is made to slide in transverse directions.

Moreover, as shown in FIGS. 2 and 3, within the frame body 3, there are separately provided a prize ball collecting conduit 24 for making a communication between the prize ball accepting opening 40 and the playing ball collecting tank 15 and output ball discharging cylinders 28 for making a communication between output ball discharging exits (not shown) of the pachinko game machines 2 and the playing ball collecting tank 15. The prize ball accepting openings 40 are situated above the prize ball collecting conduit 24, while the playing ball collecting tank 15 is located under the prize ball collecting conduit 24. With this arrangement, the prize balls thrown into the prize ball accepting opening 40 can flow through the prize ball collecting conduit 24 into the playing ball collecting tank 15, and the output balls discharged from the pachinko game machine 2 can also advance through the output ball discharging conduit 28 into the playing ball collecting tank 15.

Furthermore, at a downstream side end portion of the prize ball collecting conduit, there is installed a prize ball counter 25 which counts the number of prize balls passing therethrough, and on upper portions of the frame body 3 there are installed four receipt issuing devices, i.e., recording devices, 26 and four count value displaying sections 29 corresponding to the four pachinko game machines 2, respectively. In addition, each of the receipt issuing devices 26 and each of the count value display sections 29 are electrically coupled through a control unit, not shown, to the prize ball counter 25. Thus, the number of the prize balls counted by the prize ball counter 25 is displayed on the corresponding count value display section 29 and at the same time is printed by the corresponding receipt issuing device 26. The receipt printed is discharged from a receipt exit 27 toward the player.

In this case, it is also appropriate that a magnetic recording device is used as the recording device and the number of the prize balls counted is magnetically recorded in a magnetic card to be issued, or is magnetically written in a card the player posses in advance.

As mentioned above, since the frame body 3 incorporates the prize ball accepting openings 40, the prize ball counter 25 and the receipt issuing devices 26, the prize balls discharged from the pachinko game machine mounting unit 1 are returned to the same unit 1. Accordingly, it is possible to enhance the circulation of the playing balls within the unit 1 and further to eliminate the player's troubles of carrying the heavy ball boxes accommodating the prize balls, thereby avoiding piling up the ball boxes in the narrow passages of the recreation hall.

Although in the above description one prize ball counter 25 is provided within the frame body 3, in this case, in order to avoid simultaneously throwing the prize balls into a plurality of prize ball accepting openings 40, when one of the cover members 22 is in the open condition for the use of the corresponding one of the four prize ball accepting openings 40, there is a need for inhibiting the other three cover members 22 from opening. For this reason, as shown in FIG. 3, each of the cover members 22 is equipped with a locking mechanism 50 having a solenoid or the like for locking and unlocking the cover member 22 to allow and inhibit the use of the prize ball accepting opening 40. Each of the locking mechanisms (solenoid) 50 are coupled to a controller (interlocking means) 51. Through the locking mechanisms 50, the controller 51 sets all the cover members 22 into the unlocked conditions while all the cover members are in the closing states. On the other hand, when one of the cover members 22 is opened, the controller 51 changes the other three cover members 22 into the locked conditions. In the case that the prize ball collecting conduit 24 and the prize ball counter 25 are provided for each of the pachinko game machines 2, there is no need for providing the aforesaid lock mechanisms 50 and the controller 51. Further, in this case, it is also possible that without the provision of the prize ball collecting conduit 24 a prize ball counter is provided for each of the pachinko game machines 2 so that the prize balls thrown into the prize ball accepting opening 40 are counted by that prize ball counter.

As shown in FIG. 1, eyebolts 30 being one example of the hanger are fixedly secured onto four corners of an uppermost frame portion 3*a*, i.e., the ceiling plate of the frame body 3. Thus, in the case that the pachinko game machine mounting unit 1 is loaded on a truck or when it is put down from the truck, by using the eyebolts 30 it is possible to load and unload the pachinko game machine unit 1 fast on and from the truck. In addition, as shown in FIGS. 2 and 3, roller casters 31 being one example of the moving roller are fixedly secured onto four corners of the lowermost frame portion 3*b*, i.e., the bottom plate, of the frame body 3. Thus, by using the roller casters 31 it is possible to easily perform the movements and positioning of the pachinko game machine mounting unit 1 carried into the recreation hall.

Furthermore, onto the lowermost frame portion 3*b* there are fixedly secured leveling devices 32 useful for setting the pachinko game machine mounting unit 1 in the horizontal position. With this structure, after the pachinko game machine mounting unit 1 is moved up to a predetermined place, threaded leg portions 32*a* of the leveling devices 32 can be rotated to lift the roller casters 31, with the result that the fixing and leveling of the pachinko game machine mounting unit 1 become easy.

Moreover, as shown in FIG. 1, in both side frame portions 3*c*, i.e., both side plates, of the frame body 3 there are formed connecting holes (connecting means) 33 engaged with connecting bolts (not shown). Further, a nut (connecting means) aligned with each of the connecting holes 33 is fixedly secured to an inner wall surface of one of the side frame portions 3*c*. Thus, in a such a manner that the connecting bolts are fitted into the connecting holes 33 after the pachinko game machine mounting units 1 are placed adjacent to each other, the adjacent pachinko game machine mounting units 1 can certainly be interconnected fixedly to each other. With the successive interconnections between the pachinko game machine mounting units 1, a pachinko island with an arbitrary length is producible with ease. Incidentally, it is also appropriate to adopt a connecting means with a structure which allows the pachinko game machine mounting units 1 to be simply interconnectable with each other.

As described above, in the arrangement of the pachinko game machine mounting unit 1 according to this invention, the playing balls can be circulated at every unit and a receipt with a printed mark indicating the number of the prize balls can be issued toward each player who is playing in front of the pachinko game machine, and hence the removal and supply of the playing balls become unnecessary or can extremely be reduced in the number of times. Moreover, since the pachinko game machine mounting unit is simplified, in the case of the occurrence of troubles, the countermeasures can be taken to each unit, thus making the exchanging work simple and minimizing the degree of the breakdown. Still further, the aforesaid arrangement can promote the mass production, shorten the construction period, and reduce the construction cost of the pachinko island.

It should be understood that the foregoing relates to only a preferred embodiment of the present invention, and that it is intended to cover all changes and modifications of the embodiment of the invention herein used for the purposes of the disclosure, which do not constitute departures from the spirit and scope of the invention. For example, limitation is not imposed on the number of the pachinko game machine fitting sections as long as two or more pachinko game machines 2 can be set to the pachinko game machine mounting unit 1. In addition, in a case where the pachinko game machines 2 are attached to the inner walls of the recreation hall, there is no need for the pachinko game machines 2 to be disposed back-to-back, and the pachinko game machine mounting unit 1 can be arranged to have the pachinko game machine fitting sections only on one side. Furthermore, in the case that the playing ball supply tank 14 and the playing ball collecting tank 15 within the frame body 3 are made to have a relatively small capacity, there is a possibility that the playing ball supply tank 14 and the playing ball collecting tank 15 become simultaneously vacant or are concurrently filled with the playing balls depending upon the output of the playing balls from the pachinko game machine 2 or the number of the prize balls thrown into the prize ball accepting opening 40. Accordingly, it is also appropriate that a playing ball supply apparatus and a playing ball discharging apparatus are movably provided on a ceiling or the like of the recreation hall so that they moves to supply the playing balls to the tanks 14, 15 or pick out the playing balls therefrom on all such occasions.

What is claimed is:

1. A pachinko game machine unit comprising:

a frame body into which is to be placed a plurality of pachinko game machines;

a playing ball supply tank disposed at an upper portion of said frame body for supplying playing balls to all of said plurality of pachinko machines in said frame body;

a playing ball collecting tank disposed at a lower portion of said frame body for collecting the playing balls from all of said machines in said frame body;

raising means connected between said playing ball collecting tank and said playing ball supply tank for carrying the playing balls from said playing ball collecting tank to said playing ball supply tank;

a prize ball accepting opening formed for each of said plurality of pachinko game machines;

a prize ball counter disposed on said frame body for counting prize balls loaded into a said prize ball accepting opening; and a recording device disposed on said frame body for recording the number of the prize balls counted by a said prize ball counter.

2. A pachinko game machine unit as defined in claim 1, wherein a said prize ball counter is provided for each of said plurality of pachinko game machines.

3. A pachinko game machine unit as defined in claim 1, further comprising a hanger on an uppermost portion of said frame body.

4. A pachinko game machine unit as defined in claim 1, further comprising a moving roller on a lowermost portion of said frame body, said roller being provided with coupling means for allowing a connection with a different pachinko game machine unit.

5. A pachinko game machine unit as defined in claim 1, further comprising coupling means as a side portion of said frame body for allowing a connection with a different pachinko game machine unit.

6. A pachinko game machine unit as defined in claim 1, and further comprising:

a cover member for opening and closing each of said plurality of prize ball accepting openings;

a locking mechanism connectable and disconnectable with and from each of said cover members for locking and unlocking each of said cover members; and interlocking means for, when one locking mechanism is in an unlocking condition, causing the other looking mechanisms to come into a locking conditions.

7. A pachinko game machine unit as defined in claim 6, wherein said cover members each constitute a portion of a counter table and are slidable.

8. A pachinko game machine unit as defined in claim 6, wherein there is one said prize ball counter for counting the prize balls from the prize ball accepting openings of all of said plurality of pachinko machines.

9. A pachinko game machine unit as defined in claim 1, wherein a said recording device is provided for each of said plurality of pachinko game machines.

10. A method of producing a pachinko island comprising arranging and setting in a curvilinear row a plurality of the pachinko game machine units as defined in claim 1 and placing a decorative member between adjacent pachinko game machine units.

* * * * *